US007997697B2

(12) United States Patent
Arawaka et al.

(10) Patent No.: US 7,997,697 B2
(45) Date of Patent: Aug. 16, 2011

(54) DROPLET DISCHARGE HEAD, DROPLET DISCHARGE DEVICE, METHOD FOR MANUFACTURING DROPLET DISCHARGE HEAD AND METHOD FOR MANUFACTURING DROPLET DISCHARGE DEVICE

(75) Inventors: Katsuji Arawaka, Chino (JP); Kazufumi Oya, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 817 days.

(21) Appl. No.: 11/867,435

(22) Filed: Oct. 4, 2007

(65) Prior Publication Data

US 2008/0084451 A1 Apr. 10, 2008

(30) Foreign Application Priority Data

Oct. 5, 2006 (JP) ..... 2006-274068

(51) Int. Cl.
*B41J 2/045* (2006.01)

(52) U.S. Cl. ..... 347/72; 347/44; 347/45; 347/47; 347/48; 347/49; 347/50; 347/51; 347/52; 347/53; 347/54; 347/55; 347/56; 347/57; 347/58; 347/59; 347/60; 347/61; 347/62; 347/63; 347/64; 347/65; 347/66; 347/67; 347/68; 347/69; 347/70; 347/71

(58) Field of Classification Search ..... 347/44–45, 347/47–72
See application file for complete search history.

(56) References Cited

U.S. PATENT DOCUMENTS 6,231,169 B1 5/2001 Yazaki et al.
6,332,672 B1 12/2001 Yazaki et al.
6,378,996 B1 * 4/2002 Shimada et al. ..... 347/70
6,609,280 B2 * 8/2003 Kitahara ..... 29/25.35
7,255,428 B2 * 8/2007 Hara ..... 347/70
7,306,744 B2 * 12/2007 Matsuo et al. ..... 216/27
7,530,670 B2 * 5/2009 Matsushita et al. ..... 347/54
7,585,423 B2 * 9/2009 Nakanishi ..... 216/27
2005/0269289 A1 * 12/2005 Matsuo et al. ..... 216/27
2007/0019043 A1 * 1/2007 Oya ..... 347/70
2008/0043068 A1 * 2/2008 Oya et al. ..... 347/70

FOREIGN PATENT DOCUMENTS

DE 3238608 4/1984
JP 09-020008 1/1997
JP 11-115179 4/1999
JP 11-245408 9/1999
JP 11-320871 11/1999
JP 2000-043258 2/2000
JP 2000-108342 4/2000

* cited by examiner

*Primary Examiner* — Ryan Lepisto
*Assistant Examiner* — Guy G Anderson
(74) *Attorney, Agent, or Firm* — Maschoff Gilmore & Israelsen

(57) ABSTRACT

A droplet discharge head including a nozzle substrate having nozzle openings, a cavity substrate having discharge chambers that communicate with the nozzle openings and discharge droplets from the nozzle openings, a reservoir substrate having a reservoir concave portion that serves as a reservoir which communicates commonly with the discharge chambers. The reservoir substrate is provided between the nozzle substrate and the cavity substrate and a resin thin film is formed on a whole inner face of the reservoir concave portion and on a bottom face of a second concave portion. The second concave portion is provided in a peripheral of the reservoir concave portion and has a depth which is smaller than the depth of the reservoir concave portion. The resin thin film is cut circularly so as to surround the reservoir concave portion, and a part of the resin thin film serves as a diaphragm buffering pressure variation. serves as a diaphragm buffering pressure variation.

6 Claims, 10 Drawing Sheets

DROPLET DISCHARGE HEAD, DROPLET DISCHARGE DEVICE, METHOD FOR MANUFACTURING DROPLET DISCHARGE HEAD AND METHOD FOR MANUFACTURING DROPLET DISCHARGE DEVICE

BACKGROUND OF THE INVENTION

1. Technical Field

The present invention relates to a droplet discharge head, a droplet discharge device, a method for manufacturing the droplet discharge head and a method for manufacturing the droplet discharge device.

2. Related Art

As one of droplet discharge heads which discharge droplets, an ink-jet head mounted on an ink-jet storage device has been known. A typical ink-jet head includes a nozzle substrate in which a plurality of nozzle openings through which ink droplets are discharged is formed, a discharge chamber coupled to the nozzle substrate and which communicates with the nozzle openings in the nozzle substrate, and a cavity substrate in which an ink flow channel such as a reservoir is formed. Droplets are discharged through a selected nozzle opening when a driving part puts pressure on the discharge chamber. As for the discharge means, there are various methods such as an electrostatic method, a piezoelectric method using piezoelectric elements and a heating method using heater elements.

An ink-jet head having a plurality of raw of nozzles is required in order to increase a speed of printing and to realize a color printing. Moreover, nozzle density becomes highly concentrated and a nozzle length of the nozzle array becomes longer (or the number of nozzles per line is increasing) so that the numbers of actuators in an ink-jet head are recently increasing.

The ink-jet head has the reservoir that communicates with the discharge chamber. The reservoir is provided in each discharge chamber so that the pressure put on one of the discharge chambers is transmitted to the reservoir and the pressure affects the other discharge chamber and the nozzle openings which communicate with the discharge chamber especially when the nozzle openings are densely arranged. More specifically, when for example a positive pressure is put on the reservoir, an ink droplet can be discharged both from an unintended nozzle which is not driven and the intended nozzle (driven nozzle). When a negative pressure is put on the reservoir, the amount of the ink droplet discharged from the intended nozzle can become short from the appropriate amount and this deteriorates the printing quality.

JP-B-2-59769 (page 1, FIGS. 1-2) is a first example of related art. This patent document disclosed a technique which prevents such pressure interference among the nozzles. According to the example, an ink distributing plate having a diaphragm is provided on a member in which nozzles are formed.

However, the technique disclosed in the document makes it difficult to make the size of the ink-jet head smaller and thinner because the ink distributing plate is separately provided and coupled to the member in which the nozzles are formed.

JP-A-11-115179 (page 2, FIGS. 1-2) is a second example of related art. The second patent document disclosed an ink-jet head in which the diaphragm buffering the variation in the pressure of the reservoir is provided in the nozzle substrate.

However, the ink-jet head disclosed in the second example has the reservoir which is formed in the same substrate (cavity substrate) in which the discharge chamber is formed. In this case, from the perspective of securing sufficient volume of the reservoir, it is difficult to provide the diaphragm together with the reservoir in the same substrate. For this reason, the diaphragm is provided in a nozzle substrate according to the second example. However, a part that has a low strength is exposed in this configuration so that the diaphragm cannot be made much thinner. Moreover, a protection cover and the like will be required.

SUMMARY

An advantage of the present invention is to provide a droplet discharge head in which a dense nozzle arrangement is possible and it is possible to prevent the pressure interference among the nozzles, and to provide a droplet discharge device thereof, a method for manufacturing the droplet discharge head and a method for manufacturing the droplet discharge device.

A droplet discharge head according to a first aspect of the invention includes:

a nozzle substrate having a nozzle opening, the nozzle opening being provided in a plural number;

a cavity substrate having a discharge chamber that communicates the nozzle opening and discharges a droplet from the nozzle opening, the discharge chamber is provided in a plural number, and each of the discharge chambers independently communicating with the corresponding nozzle opening;

a reservoir substrate having a reservoir concave portion that serves as a reservoir which communicates commonly with the discharge chambers, the reservoir substrate being provided between the nozzle substrate and the cavity substrate; and a resin thin film formed on a whole inner face of the reservoir concave portion and on a bottom face of a second concave portion, the second concave portion being provided in a peripheral of the reservoir concave portion and having a depth smaller than a depth of the reservoir concave portion, wherein the resin thin film provided on the bottom face of the second concave portion is cut circularly so as to surround the reservoir concave portion, and a part of the resin thin film provided on a bottom face of the reservoir concave portion serves as a diaphragm buffering pressure variation.

According to the first aspect of the invention, the diaphragm is formed separately from the discharge chamber in the substrate (the reservoir substrate) other than the substrate of the discharge chamber (the cavity substrate). Thereby it is possible to secure a sufficient volume of the reservoir and it is possible to provide the diaphragm inside the reservoir. Consequently, the nozzles can be arranged densely. In addition, the compliance of the reservoir can be reduced and this decreases the pressure variation in the reservoir. As a result, it is possible to prevent the pressure interference among the nozzles which occurs when the ink is discharged. In this way, a fine discharge characteristic can be obtained.

Moreover, according to the first aspect, the whole bottom face of the reservoir can serve as the diaphragm thereby it is possible to make the area of the diaphragm large. Consequently, the pressure buffering effect of the diaphragm can be increased.

Furthermore, the resin thin film is not formed the bonding faces of the reservoir substrate with the nozzle substrate and with the cavity substrate. Thereby the deterioration of the adhesiveness at the bonding faces will not occur since the resin thin film is not interposed therebetween.

Moreover, the resin thin film is formed throughout the inner face of the reservoir concave portion so that the contact area of the resin thin film and the reservoir substrate becomes relatively large. Therefore it is possible to secure a sufficient adhesion of the resin thin film.

In this case, a void part may be provided on a side opposite to the reservoir concave portion with respect to the resin thin film provided on the bottom face of the reservoir concave portion, and the void part may be formed by etching the reservoir substrate from a surface opposite to a face where the reservoir concave portion is formed to the diaphragm.

In this way, the diaphragm is provided in the reservoir substrate and the diaphragm is situated between the nozzle substrate and the cavity substrate. Thereby an external force will not be directly applied to the diaphragm and it is possible to make the diaphragm thinner. In addition, it is possible to enhance the strength of the head unit against the external force without providing a protection member such as a protection cover.

Furthermore, the void space is formed on the both sides of the diaphragm so that the diaphragm can vibrate into these spaces.

Moreover, it is not necessary to process the cavity substrate and the nozzle substrate in order to form the void part. Therefore the design or processing of the cavity substrate and the nozzle substrate will not be affected.

In this case, the second concave portion may have a depth larger than a thickness of the resin thin film. In this way, the surface of the resin thin film will not protrude out from the surface of the second concave portion. Accordingly, deterioration of the adhesiveness caused by the resin thin film contacting with the nozzle substrate will not happen.

It is preferable that the resin thin film be made of parylene because it is possible to form a defect-free resin thin film which has a fine coatability and is highly resistant against heat, chemicals and vapor. In addition, the film made of the parylene is more flexible than a film made of for example silicon so that it can exert a high pressure absorption effect.

It is preferable that the void part be provided on a bonding face of the reservoir substrate where the cavity substrate is bonded. The void part in which the diaphragm is deflected is provided on the side of the bonding face of the cavity substrate. Thereby, the reservoir concave portion of the reservoir is placed on the nozzle substrate side and the reservoir can be placed such that it sterically overlaps the discharge chamber of the cavity substrate. In this way, it is possible to minimize the area of the ink-jet head.

A droplet discharge device according to a second aspect of the invention is equipped with the above-described droplet discharge head. Thereby it is possible to obtain a droplet discharge device equipped with a droplet discharge head having a fine discharge characteristic because the pressure interference among the nozzle that occurs when droplets are discharged is prevented.

According to a third aspect of the invention, a method for manufacturing a droplet discharge head including at least a nozzle substrate that has a plurality of nozzle openings, a cavity substrate that has a plurality of discharge chambers, each of the discharge chambers communicating with the corresponding nozzle opening and discharging a droplet from the nozzle opening with a pressure generated in the chamber, and a reservoir substrate that has a reservoir communicating commonly with the discharge chambers and is provided between the nozzle substrate and the cavity substrate, and in which a diaphragm having a resin thin film that buffers the pressure variation is provided on a bottom face of the reservoir includes:

a) forming a reservoir concave portion and a second concave portion from a first face of a silicon base substrate that is going to become the reservoir substrate, the reservoir concave portion serving as the reservoir, and the second concave portion being provided in a peripheral of the reservoir concave portion and having a depth smaller than a depth of the reservoir concave portion;

b) covering the first face of the silicon base substrate other than an area of an opening of the reservoir concave portion and an opening of the second concave portion, and a second face of the silicon base substrate that is an opposing face to the first face with a mask;

c) forming the resin thin film;

d) cutting the resin thin film on a bottom face of the second concave portion in a circularly pattern so as to surround the reservoir concave portion;

e) removing the mask provided on the first face and the second face of the silicon base substrate; and f) dry-etching the silicon base substrate so as to form the diaphragm from the second face until the resin thin film is exposed.

According to the third aspect of the invention, a part of the resin thin film formed on the reservoir substrate is used as the diaphragm without performing an additional processing so that the manufacturing process is simplified.

Moreover, the resin thin film is formed only on the inner face of the reservoir concave portion and the bottom face of the second concave portion. The resin thin film is not formed the bonding faces of the reservoir substrate with the nozzle substrate and with the cavity substrate. Thereby the deterioration of the adhesiveness at the bonding faces will not occur since the resin thin film is not interposed therebetween.

Furthermore, according to the third aspect of the invention, a part of the resin thin film is cut in the second concave portion, and the unnecessary part of the resin thin film is removed when the mask is removed. This simplifies the manufacturing process.

In this case, it is preferable that the resin thin film be formed by depositing parylene.

In this way, it is possible to form a defect-free resin thin film which has a fine coatability and is highly resistant against heat, chemicals and vapor. In addition, the thin film made of the parylene can exert the pressure absorption effect greater than that of for example a silicon thin film because the parylene film is more flexible than the silicon film.

It is also preferable that the resin thin film be cut by leaser. In this way, the resin thin film can be cut along the desired line.

It is also preferable that the mask covering the first face of the silicon base substrate have an opening only in a position opposite to an opening of the reservoir concave portion, the opening of the mask be larger than the opening of the reservoir concave portion.

In this way, even if the mask is not well aligned with the reservoir substrate, the resin thin film is securely formed on the second concave portion. Accordingly it is possible to secure the cutting region of the resin thin film.

It is also preferable that a surface of the parylene thin film be made hydrophilic by an oxide plasma treatment. In this way, it is easy to secure the hydrophilicity of the droplet flow channels.

It is also preferable that a sulfur hexafluoride (SF6) plasma be used in the dry-etching for forming the diaphragm. In this way, it is possible to minimize the damage given to the resin thin film when the silicon is dry-etched.

A method for manufacturing a droplet discharge device according to a fourth aspect of the invention includes a process of the above-described method for manufacturing a droplet discharge head.

In this way, it is possible to obtain a droplet discharge device equipped with a droplet discharge head having a fine discharge characteristic.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described. A droplet discharge head to which the invention is applied is described as a first embodiment. Here, a face-discharge type ink-jet head which discharges ink droplets from nozzle openings provided on the surface of a nozzle substrate is described as an example of the droplet discharge head of the embodiment. The invention is obviously not limited to the structures and the elements shown in the accompanying drawings, but also encompasses any variations that may be considered by any person skilled in the art, within the general scope of the invention. For example, the invention can also be applied to an edge-discharge type droplet discharge head which discharges ink droplets through nozzle openings provided on the edge of a substrate. Moreover, though the actuator described hereunder is an electrostatic driving type, the actuator can be any driving types.

First Embodiment

Figure 1:
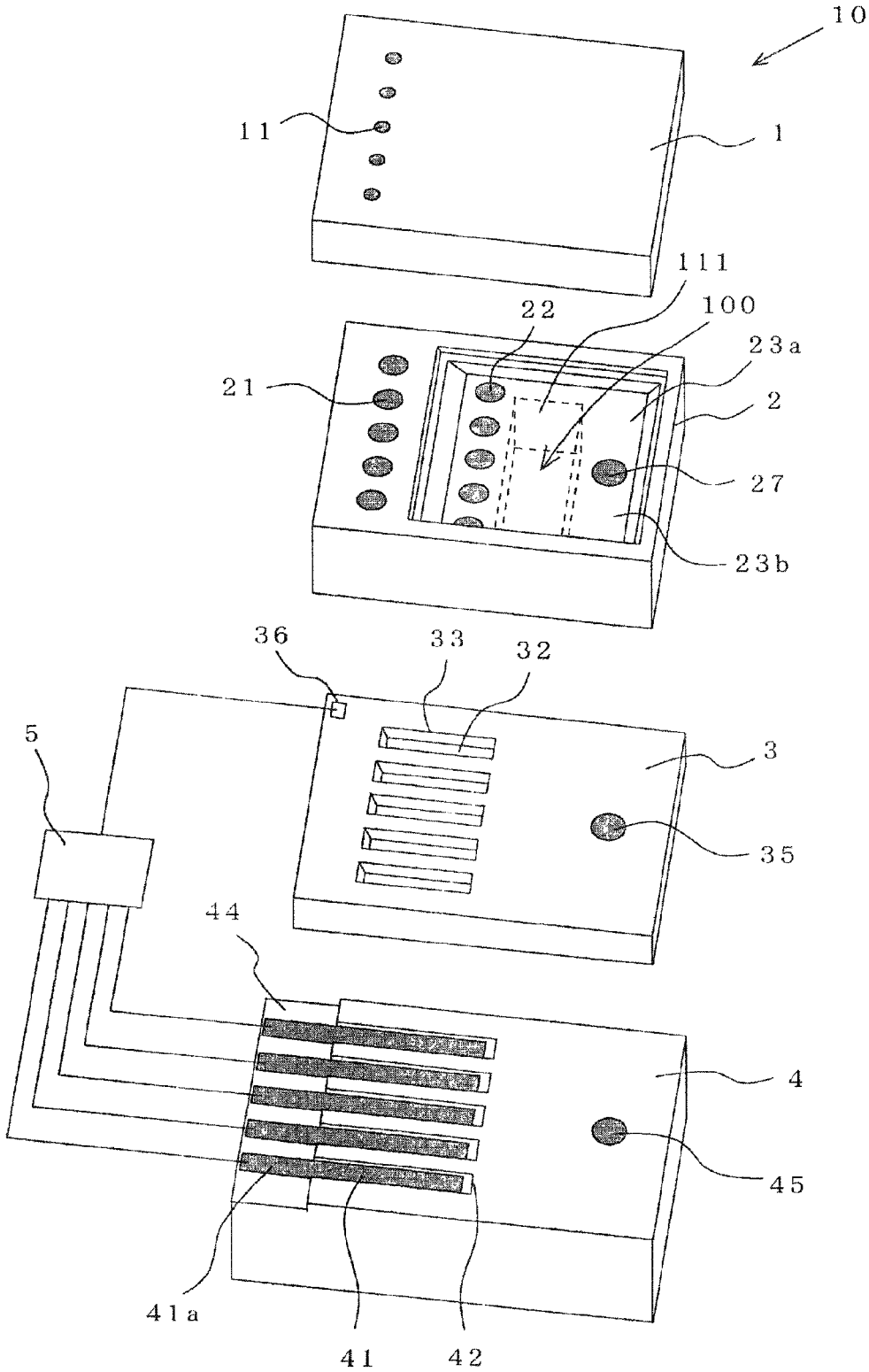
FIG. 1 is an exploded perspective view of an ink-jet head according to a first embodiment of the invention.
Figure 2:
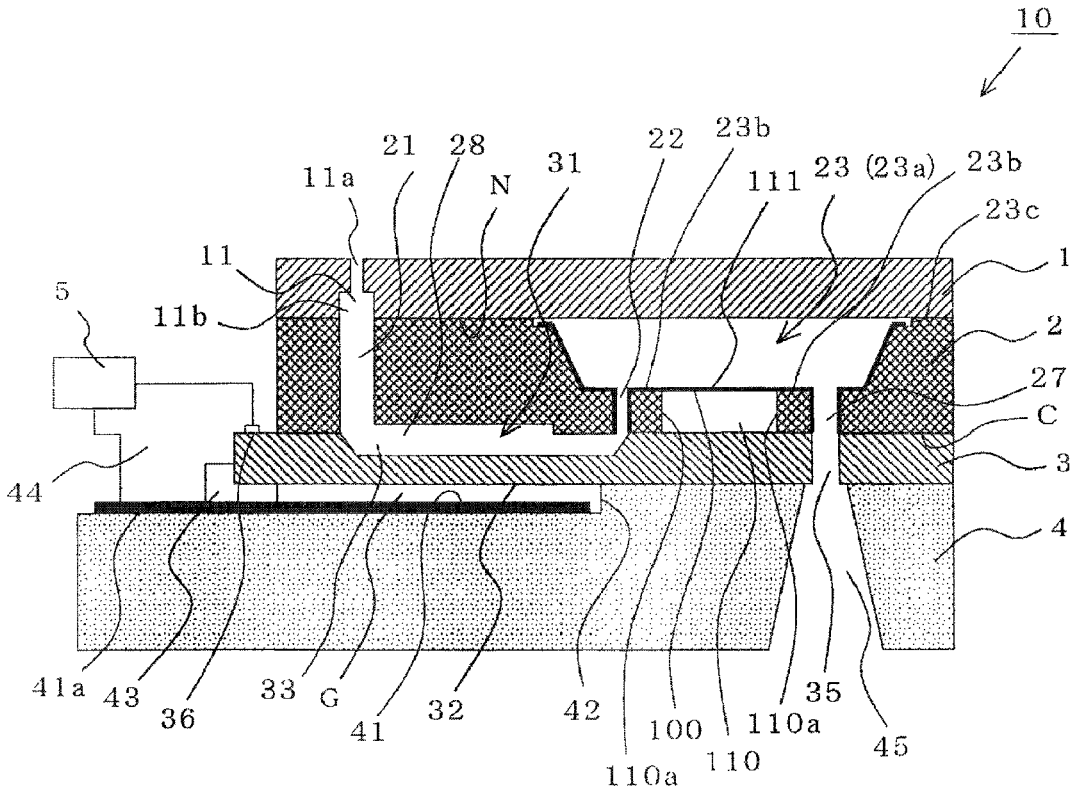
FIG. 2 is a sectional view of the ink-jet head shown in FIG. 1 showing its assembling structure.

FIG. 1 is an exploded perspective view of an ink-jet head according to the first embodiment of the invention. FIG. 2 is a longitudinal sectional view of the ink-jet head shown in FIG. 1 showing its assembling structure. The ink-jet head is drawn upside down in the FIG. 1 and FIG. 2 from the normally usage state.

Unlike a typical electrostatic driving type ink-jet head that has a three-layered structure including a nozzle substrate, a cavity substrate and an electrode substrate which are adhered together, an ink-jet head 10 (an example of the droplet discharge head) shown in FIG. 1 and FIG. 2 has a four-layered structure including a nozzle substrate 1, a reservoir substrate 2, a cavity substrate 3 and an electrode substrate 4 which are adhered together in this order. In other words, the discharge chamber is provided on a substrate other than the substrate in which the reservoir is provided. The detailed structure of each substrate is followed.

The nozzle substrate 1 is for example about 50 μm thick and made of silicon. A nozzle opening 11 is provided in the plural number in a predetermined pitch in the nozzle substrate 1. Though only five nozzle openings 11 arranged in a row are shown in FIG. 1 for the sake of simplification, the nozzles can be arranged in more than one row.

Each nozzle opening 11 has an injection tip 11*a* which is a small opening part provided coaxially and vertically to the substrate face and an introduction part 11*b* whose diameter is larger than that of the injection tip 11*a*.

The reservoir substrate 2 has a thickness of for example about 180 μm and is made of for example a (100)-silicon which has a plane direction of (100). A nozzle communicating opening 21 is provided in the plural number in the reservoir substrate 2. Each nozzle communicating opening 21 vertically penetrates the reservoir substrate 2 and communicates with the nozzle opening 11 respectively. The diameter of the nozzle communicating opening 21 is relatively large (equal or larger than the diameter of the introduction part 11*b*). A reservoir concave portion 23*a* which is a common reservoir 23 (common ink chamber) communicating with the nozzle communicating openings 21 and the nozzle openings 11 through feed openings 22 is provided in the reservoir substrate 2.

The reservoir concave portion 23*a* opens wider toward a bonding plane (hereinafter also called as an "N-plane") with the nozzle substrate 1 and its cross-sectional shape is a substantially inverted trapezoid. Under a bottom wall 23*b* of the reservoir concave portion 23*a* toward the cavity substrate 3, a void part 110 reaching a bonding plane (hereinafter also called as "C-plane") of the reservoir substrate 2 and the cavity substrate 3 is provided in the reservoir substrate 2.

Furthermore, a shallow concave portion 23*c* (second concave portion) whose depth is much smaller than that of the reservoir concave portion 23*a* is provided on the periphery of the opening of the reservoir concave portion 23*a* in the reservoir substrate 2. A resin thin film 111 is provided on the whole face of the reservoir substrate 2 (provided on the whole inner face of the reservoir concave portion 23*a* and the bottom face of the shallow concave portion 23*c*) where the reservoir concave portion is formed, but the film is not formed in the area of the bonding face with the cavity substrate 3 and on the inner face of the nozzle communicating opening 21. The shallow concave portion 23*c* is formed so as to have a smaller depth than the thickness of the resin thin film 111 and such that the top face of the thin film 111 will not protrude from the top face of the reservoir substrate 2. The resin thin film 111 is hereunder described in detail.

A part of the resin thin film 111 where opposes the void part 110 forms a part of the bottom face of the reservoir concave portion 23*a* and also serves as a diaphragm 100 which buffers the pressure variation. In other words, the part of the resin thin film 111 which faces the void part 110 floats in the space between the void part 110 and the reservoir concave portion 23*a*. The void part 110 allows the resin thin film 111 to be deflected.

The resin thin film 111 is formed in the fabrication process of the reservoir substrate 2 and is made of for example parylene.

The feed openings 22 and an ink feed opening 27 though which ink is supplied to the reservoir 23 from an outside source are formed in the bottom wall 23*b* of the reservoir concave portion 23*a* so as to avoid the diaphragm 100.

A second concave portion 28 which is a long narrow groove consisting a part of a discharge chamber 31 is formed in the C-plane of the reservoir substrate 2. The second concave portion 28 is provided in order to prevent the resistance in the flow channel of the discharge chamber 31 from being increased especially when the cavity substrate 3 is made thin. The second concave portion 28 is provided if needed and it is not necessarily formed.

The nozzle communicating opening 21 which penetrates the reservoir substrate 2 is formed so as to be coaxial to the nozzle opening 11 in the nozzle substrate 1 so that ink droplets can be discharged straight. In this way, the discharge characteristic is significantly improved. This means that an infinitesimal amount of the ink droplet can be discharged and provided at a desired position and it is possible to precisely reproduce a subtle change in tone of an image without causing a color drift and the like. Therefore it is possible to realize a fine and high image quality.

The cavity substrate 3 is made of for example silicon and has a thickness of for example about 30 μm. A first concave portion 33 which serves as the discharge chamber 31 is provided in the plural number in the cavity substrate 3. Each first concave portion 33 communicates with the corresponding nozzle communicating opening 21. The first concave portion 33 and the second concave portion 28 together forms the discharge chamber 31. The bottom wall of the discharge chamber 31 (first concave portion 33) forms a vibrating plate 32. The vibrating plate 32 can be made of a boron diffused layer which is formed by diffusing highly-concentrated boron into silicon. When the vibrating plate 32 is made of the boron diffused layer, etching stop works well in a wet-etching process. Thereby it is possible to precisely control the thickness of the vibrating plate 32 and the roughness of the plate surface.

An insulating film (not shown in the drawings) having a thickness of for example 0.1 μm and made of for example an $SiO_2$ film which is formed by plasma chemical vapor deposition (CVD) using Tetraethyl-orthosilicate Tetra-ethoxysilane (TEOS) is formed at least on the lower face of the cavity substrate 3. This insulating film is provided in order to prevent breakdown or shot-circuit when the ink-jet head 10 is driven. An ink protection film (not shown in the drawings) which is same as that of the reservoir substrate 2 is formed on the upper face of the cavity substrate 3. An ink feed opening 35 that communicates with the ink feed opening 27 in the reservoir substrate 2 is formed in the cavity substrate 3.

The electrode substrate 4 is for example a glass substrate having a thickness of about 1 mm. More specifically, it is preferable that a heat resistance and hard borosilicate glass whose thermal expansion coefficient is close to that of the silicon material of the cavity substrate 3 be used. If such heat resistance and hard borosilicate glass is adopted, it is possible to reduce the stress between the electrode substrate 4 and the cavity substrate 3 generated at the time when these substrates are anionically bonded because the thermal expansion coefficients of these substrates are close. Thereby it is possible to firmly bond the electrode substrate 4 with the cavity substrate 3 without causing any problems such as detachment.

A concave portion 42 is formed in the face of the electrode substrate 4 and provided in the plural number such that each concave portion 42 is situated correspondingly to the opposing vibrating plate 32 which is provided in the cavity substrate 3. The concave portion 42 is formed in about 0.3 μm deep by etching. At the bottom face of each concave portion 42, an individual electrode 41 which is typically made of indium tin oxide (ITO) and has a thickness of for example 0.1 μm is formed by sputtering. The size of an air gap G formed between the vibrating plate 32 and the individual electrode 41 is decided by the depth of the concave portion 42 and the thicknesses of the insulating films that cover the individual electrode 41 and the vibrating plate 32. The discharge characteristic of the ink-jet head 10 is largely affected by the size of the air gap G. In this embodiment, the size of the air gap G is 0.2 μm. An open edge of the air gap G is air-tightly sealed by a sealing member 43 which is made of an epoxy adhesive and the like. With this sealing member, it is possible to prevent foreign matter, moisture and the like from getting into the air gap G. In this way, it is possible to secure the reliability of the ink-jet head 10.

The individual electrode 41 can be made of other metals such as indium zinc oxide (IZO), gold and copper in addition to the ITO. The ITO is generally used because the ITO is transparent and the contacting state of the vibrating plate can be easily checked with eyes.

A terminal part 41*a* of the individual electrode 41 is exposed on an electrode extraction part 44 which is formed by removing the edges of the reservoir substrate 2 and the cavity substrate 3. In the electrode extraction part 44, a flexible wiring substrate (not shown in the drawings) for example on which a driving control circuit 5 such as a driver IC is mounted is coupled with the terminal parts 41*a* of the individual electrodes 41 and with a common electrode 36 which is provided on the peripheral of the cavity substrate 3.

An ink feed opening 45 which is coupled to an ink cartridge (not shown in the drawings) is provided in the electrode substrate 4. The ink feed opening 45 communicates with the reservoir 23 through the ink feed opening 35 provided in the cavity substrate 3 and the ink feed opening 27 provided in the reservoir substrate 2.

Operation of the ink-jet head 10 is now described.

Ink is firstly supplied from an external ink cartridge (not shown in the drawings) into the reservoir 23 through the ink feed openings 45, 35, 27. The supplied ink flows through the feed openings 22 and fills each discharge chamber 31 and each nozzle communicating opening 21 to the tips of the nozzle openings 11. The driving control circuit 5 such as a driver IC that controls the operation of the ink-jet head 10 is provided and coupled between the individual electrodes 41 and the common electrode 36 in the cavity substrate 3.

When the driving control circuit 5 supplies a driving signal (pulse voltage) to the individual electrode 41 and the pulse voltage is applied to the individual electrode 41, the individual electrode 41 is positively charged whereas the corresponding vibrating plate 32 is negatively charged. In this state, an electrostatic force (Coulomb force) is generated between the individual electrode 41 and the vibrating plate 32, and the vibrating plate 32 is deflected toward the individual electrode 41 by the electrostatic force. This increases the volume of the discharge chamber 31. Subsequently when the pulse voltage is turned off, the electrostatic force disappears and the vibrating plate 32 gets back to the original position by its elastic force and the volume of the discharge chamber 31 is drastically decreased. This action generates a pressure. A part of the ink in the discharge chamber 31 is pushed toward the nozzle communicating opening 21 by the pressure, and the ink is discharged from the nozzle opening 11 in a form of droplet. When the pulse voltage is applied again, the vibrating plate 32 is deflected toward the individual electrode 41, and the discharge chamber 31 is supplied with the ink from the reservoir 23 through the feed opening 22.

According to the embodiment, the pressure in the discharge chamber 31 is transmitted to the reservoir 23 when the ink-jet head 10 is driven. The diaphragm 100 having the resin thin film 111 is provided on the bottom wall 23*b* of the reservoir 23 as described above. Thereby the resin thin film 111 is deflected downward into the void part 110 when the pressure in the reservoir 23 is positive, whereas the resin thin film 111 is deflected upward from the void part 110 when the pressure in the reservoir 23 is negative. This buffers the pressure variation in the reservoir 23, and it is possible to prevent the pressure interference among the nozzle openings 11. Consequently, it is possible to eliminate the troubles such that the ink is leaked from other nozzles than the driven nozzle, the amount of the ink discharged from the driven nozzle falls short of the required amount, and the like.

Moreover, the resin thin film 111 is provided on the bottom wall 23*b* of the reservoir 23 according to the embodiment so that it is possible to increase the area of the diaphragm 100 so as to increase the pressure buffering effect.

Figure 3:
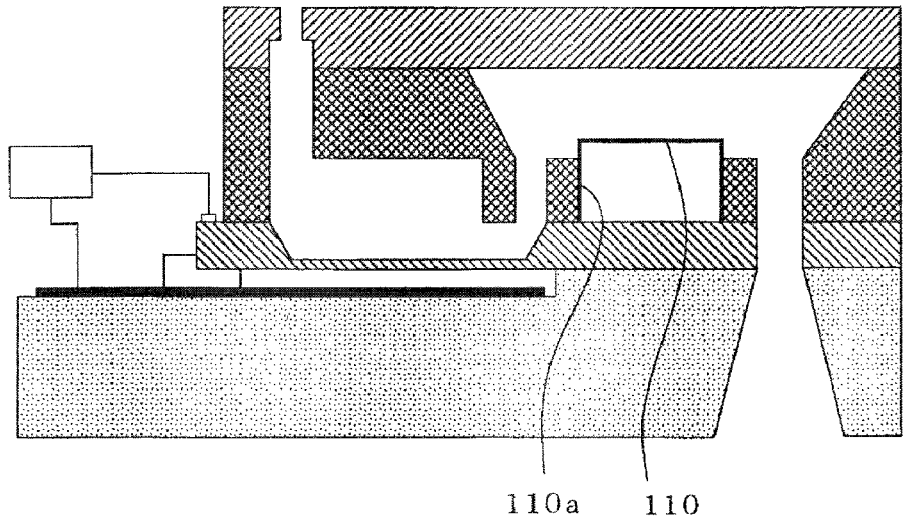
FIG. 3 shows a comparative example of a diaphragm.

Furthermore, according to the embodiment, the resin thin film 111 is formed throughout the inner face of the reservoir concave portion 23*a* and on the bottom face of the shallow concave portion 23*c*. And the resin thin film 111 which serves as the diaphragm 100 is uniformly formed on the surface of the bottom wall 23*b* of the reservoir 23, a part of the peripheral wall of the feed opening 22, and a part of the peripheral wall of the ink feed opening 27. Therefore the contact area of the resin thin film 111 and the reservoir substrate 2 becomes relatively large compared with the case shown in FIG. 3 in which the resin thin film is formed on the side walls 110*a* of the void part 110. In this way, it is possible to secure a sufficient adhesion of the resin thin film.

Furthermore, according to the embodiment, the diaphragm 100 is provided in the reservoir substrate 2, and the C-plane side is not exposed to the outside since it is covered by the cavity substrate 3. Thereby it is possible to protect the diaphragm 100 having the resin thin film 111 from external force, and it is not necessary to provide a protection member such as a protection cover. Accordingly, it is possible to downsize the ink-jet head 10 and to cut the cost.

According to the embodiment, the diaphragm 100 is formed to have a relatively large area so that it is possible to steadily deflect (vibrate) in the void part 110. A small vent (not shown in the drawings) which couples the void part 110 with the outside can be provided in the cavity substrate 3 or the electrode substrate 4 if needed.

A method for manufacturing the ink-jet head 10 according to the embodiment will be now described with reference to FIGS. 4 through 10. Values of the thickness of the substrate, an etching depth, temperature, pressure and the like hereunder presented are only an example and note that these values do not in any way limit the scope of the invention.

Figure 4A:
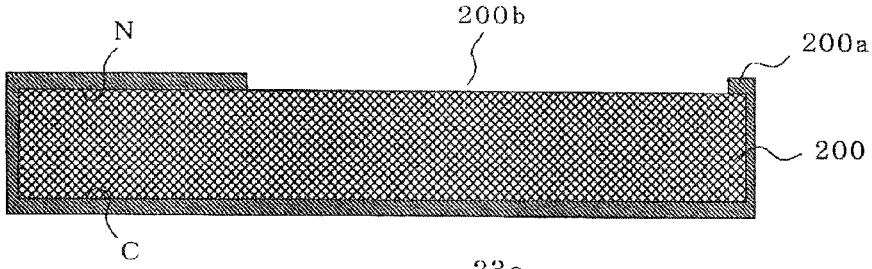
FIGS. 4A through 4F are sectional views of a reservoir substrate of the ink-jet head according to the embodiment showing its manufacturing process.
Figure 4B:
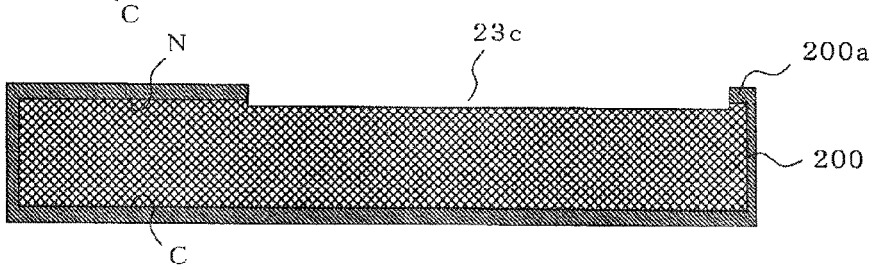
Figure 4C:
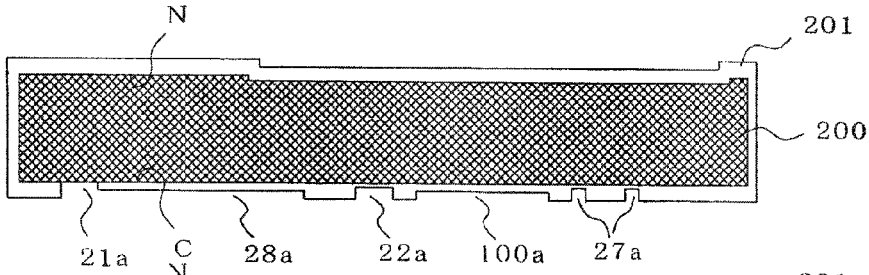
Figure 4D:
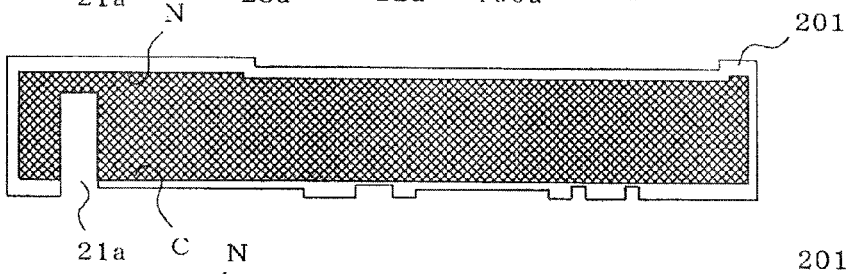
Figure 4E:
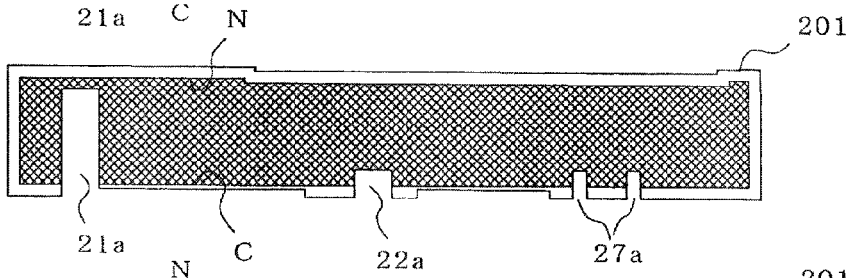
Figure 4F:
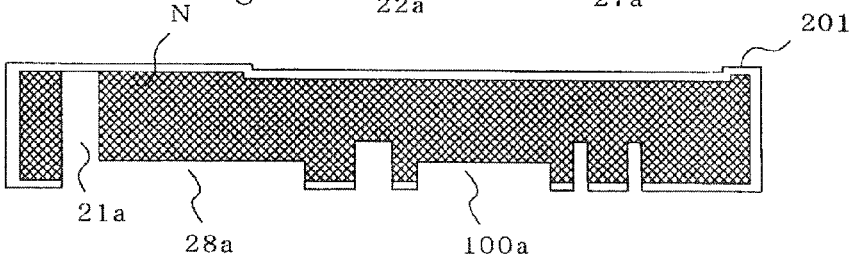
Figure 5G:
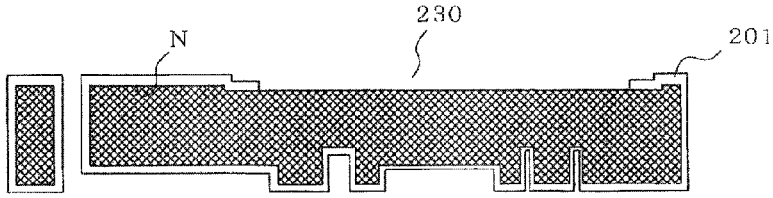
FIGS. 5G through 5K are sectional views of the reservoir substrate showing its manufacturing process following FIG. 4F.
Figure 5H:
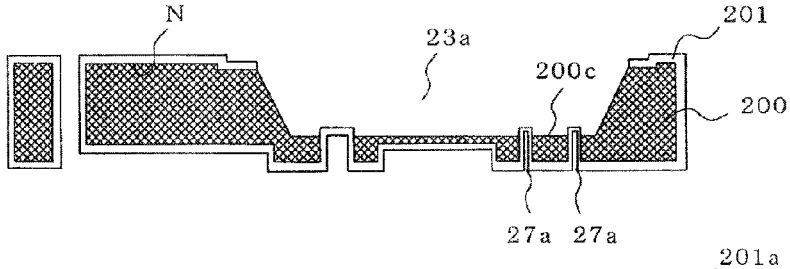
Figure 5I:
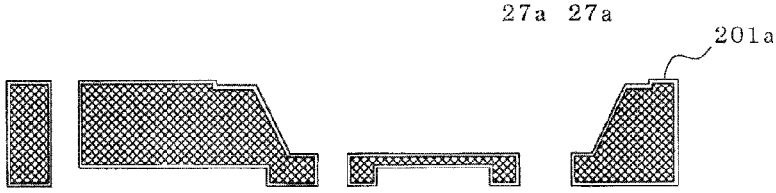
Figure 5J:
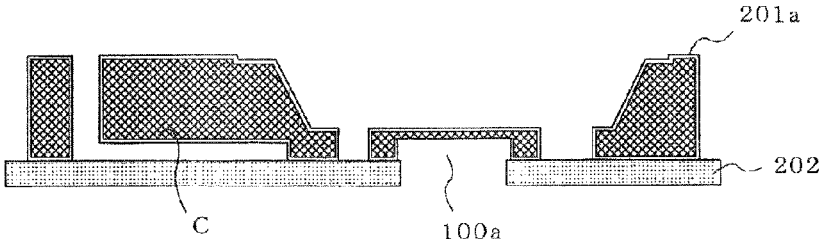
Figure 5K:
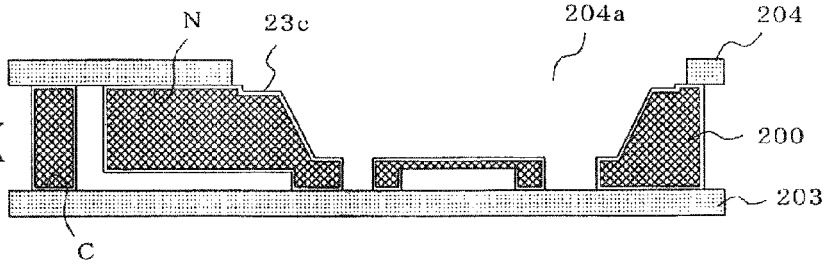
Figure 6L:
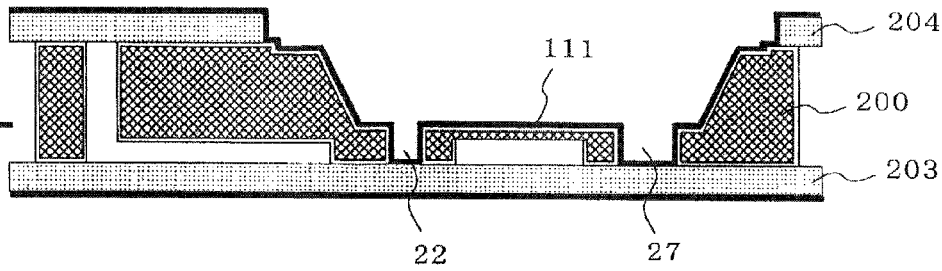
FIGS. 6L through 6O are sectional views of the reservoir substrate showing its manufacturing process following FIG. 5K.

A method for manufacturing the reservoir substrate 2 is described with reference to FIGS. 4 through 6.

a) A reservoir base substrate 200 which is made of the (100)-silicon and has a thickness of 180 μm is provided. Both faces of the reservoir base substrate 200 is coated with a resist 200*a* and a part 200*b* where the shallow concave portion 23*c* is going to be formed is patterned on a nozzle substrate bonding face (hereinafter called a "N-plane") as shown in FIG. 4A.

b) Referring to FIG. 4B, the shallow concave portion 23*c* having a depth of 1 μm is formed on the N-plane by dry-etching.

c) Referring to FIG. 4C, the resist 200*a* is removed and a thermally-oxidized film 201 having a thickness of 1.5 μm is formed on the reservoir base substrate 200. Subsequently, outer edges of parts 21*a*, 28*a*, 22*a*, 100*a*, 27*a* where respectively the nozzle communicating opening 21, the second concave portion 28, the feed opening 22, the diaphragm 100 and the ink feed opening 27 are going to be formed are patterned on the face (the C-plane) to which the cavity substrate 3 is adhered by a shaping photolithography method. At this point, the etching is performed in such a way that the film thicknesses of the remnant of the thermally-oxidized film 201 including the parts 21*a*, 28*a*, 22*a*, 100*a*, 27*a* on the C-plane have the following relation: The film thickness of the outer edge of the part 21*a* where the nozzle communicating opening 21 is going to be formed=0<the film thickness of the part 22*a* where the feed opening 22 is going to be formed=the film thickness of the part 27*a* where the ink feed opening 27 is going to be formed<the film thickness of the part 28*a* where the second concave portion 28 is going to be formed=the film thickness of the part 100*a* where the diaphragm 100 is going to be formed.

d) Referring now to FIG. 4D, the part 21*a* where the nozzle communicating opening 21 is going to be formed in the C-plane is formed through dry-etching of about 150 μm using inductively coupled plasma (IPC).

e) Referring to FIG. 4E, the thermally-oxidized film 201 is appropriately etched so as to open the part 22*a* where the feed opening 22 is going to be formed and the outer edge 27*a* where the ink feed opening 27 is going to be formed. Subsequently, the film is dry-etched about 15 μm by using the IPC.

f) Referring to FIG. 4F, the thermally-oxidized film 201 is appropriately etched so as to open the part 28*a* where the second concave portion 28 is going to be formed and the part 100*a* where the diaphragm 100 is going to be formed. Subsequently, the film is dry-etched about 25 μm by using the IPC. At this point, the part 21*a* where the nozzle communicating opening 21 is going to be formed is also etched so as to form the opening till it reaches the N-plane.

g) Referring now to FIG. 5G, the thermally-oxidized film 201 is removed and the thermally-oxidized film 201 having a thickness of 1.0 μm is then formed again as shown in FIG. 5G. A part 230 where the reservoir concave portion 23*a* is going to be formed is opened in the film on the face (the N-plane) which is adhered to the nozzle substrate 1 by photolithography.

h) Referring to FIG. 5H, the film is wet-etched about 150 μm by using potassium hydroxide (KOH) so as to form the reservoir concave portion 23*a*. In this step, a silicon part 200*c* where the ink feed opening 27 is going to be formed is separated from the silicon (reservoir) base substrate 200 with the outer edge 27*a*.

i) The thermally-oxidized film 201 is removed and a thermally-oxidized film 201*a* having a thickness of 0.2 μm is then formed as shown in FIG. 5I.

j) Referring to FIG. 5J, a mask 202 made of metal or silicon and having an opening at the position where corresponds to the part 100*a* where the diaphragm 100 is going to be formed is placed over the C-plane. Dry-etching is then performed to remove a part of the thermally-oxidized film 201*a* so as to form the part 100*a* where the diaphragm 100 is going to be formed.

k) Referring to FIG. 5K, the whole C-plane of the reservoir base substrate 200 is protected by a protection film 203. The N-plane of the reservoir base substrate 200 is protected by a protection film 204 (a mask) having an opening 204*a* which is larger than the size of the reservoir concave portion 23*a*. The reason why the protection film 204 having the opening 204*a* which is larger than the size of the reservoir concave portion 23*a* is used is that the resin thin film 111 is to be formed also on the bottom face of the shallow concave portion 23*c*.

l) Referring now to FIG. 6L, the reservoir base substrate 200 that is protected by the protection films 203, 204 is put into a vacuum chamber, and the resin thin film 111 made of parylene and having a thickness of 1.0 μm is formed on the whole surface of the substrate. The film of the parylene is formed through sublimating and pyrolyzing diparaxylylene (dimer). The parylene is softer than a silicon thin film so that the resin thin film 111 made of the parylene can exert the pressure absorption effect 100-1000 times greater than that of the case where the resin thin film 111 is made of the silicon thin film.

Figure 6M:
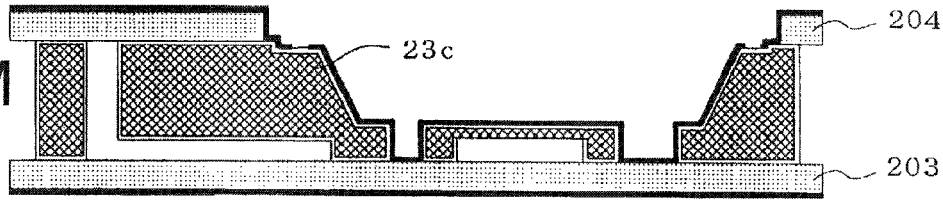
Figure 6N:
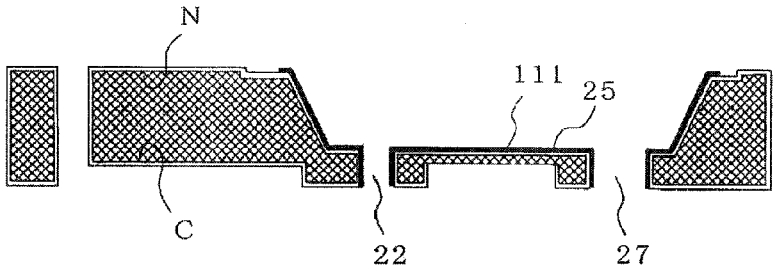
Figure 6O:
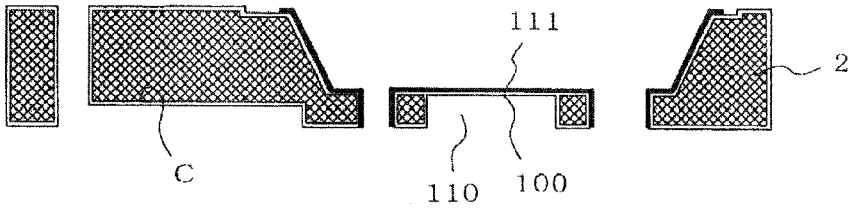

As described above, the resin thin film 111 is formed in the manufacturing process of the reservoir substrate 2.

m) Referring to FIG. 6M, the shallow concave portion 23*c* existing on the peripheral of the reservoir concave portion 23*a* is irradiated with laser and a part of the resin thin film 111 is removed (cut). More specifically, the film is cut circularly so as to surround the reservoir concave portion 23*a*. In this way, the shallow concave portion 23*c* serves as a cut region for the resin thin film 111.

n) Referring to FIG. 6N, the protection films 203, 204 are removed from the N-plane and the C-plane. At this point, an unnecessary part (an outer part from the cutting line) of the resin thin film 111 is also removed together with the protection film 204. The parts of the resin thin film 111 where corresponds to the feed opening 22 and the ink feed opening 27 are removed on the C-plane by using oxygen plasma. Hydrophilicity is imparted to the surface of the N-plane by using the oxygen plasma to the extent where the parylene is not removed.

o) Referring to FIG. 6O, the part of the silicon where the void part 110 is going to be formed is removed from the C-plane by using a sulfur hexafluoride (SF6) plasma. Consequently, the resin thin film 111 is exposed and the diaphragm 100 is completed.

Through the above-described process, the reservoir substrate 2 is fabricated.

Manufacturing processes of the electrode substrate 4 and the cavity substrate 3 are now described with reference to FIGS. 7 through 9. A manufacturing process till the ink-jet head is completed will be described with reference to FIG. 10.

Figure 7A:
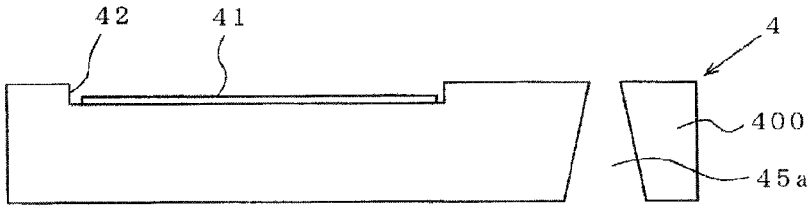
FIGS. 7A through 7D are sectional views of an electrode substrate and a cavity substrate showing their manufacturing process.

The electrode substrate 4 is fabricated in the following manner.

a) Referring now to FIG. 7A, a glass substrate 400 made of borosilicate glass or the like and having a thickness of about 1 mm is provided. The concave portion 42 is formed in the glass substrate through an etching using hydrofluoric acid with an etching mask made of gold and chrome. The concave portion 42 is a groove whose size is slightly larger than the size of the individual electrode 41. The concave portion 42 is formed with respect to each individual electrode 41 so that the concave portion 42 is provided in the plural number.

Figure 7B:
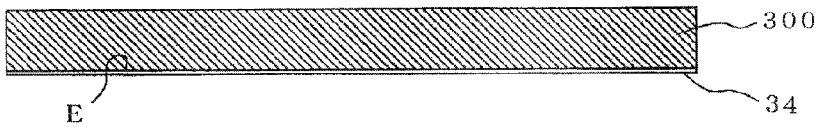
Figure 7C:
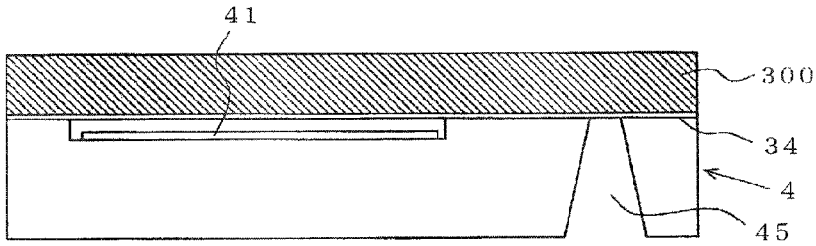
Figure 7D:
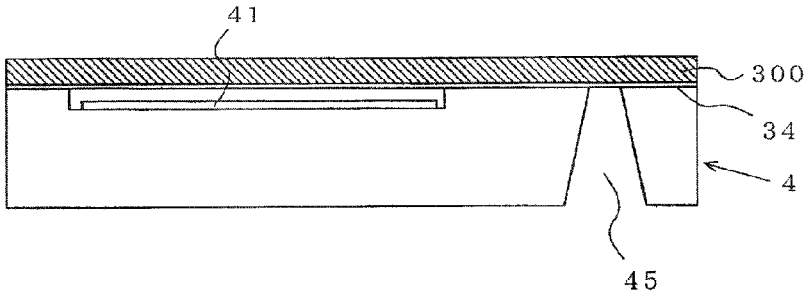
Figure 8E:
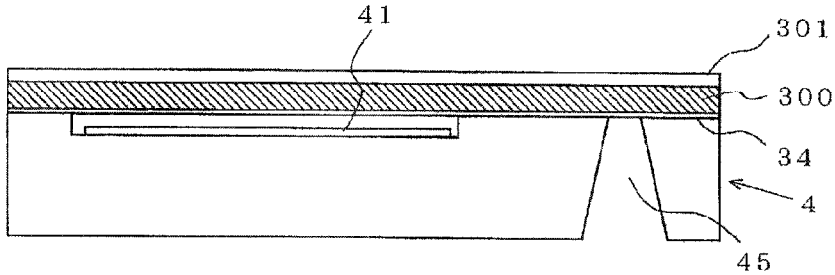
FIGS. 8E through 8H are sectional views of the electrode substrate and the cavity substrate showing their manufacturing process following FIG. 7D.
Figure 8F:
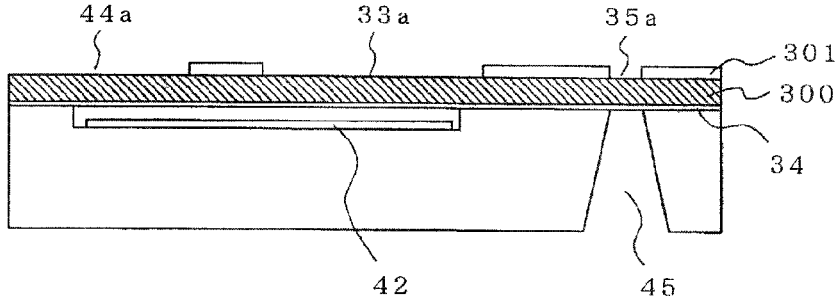
Figure 8G:
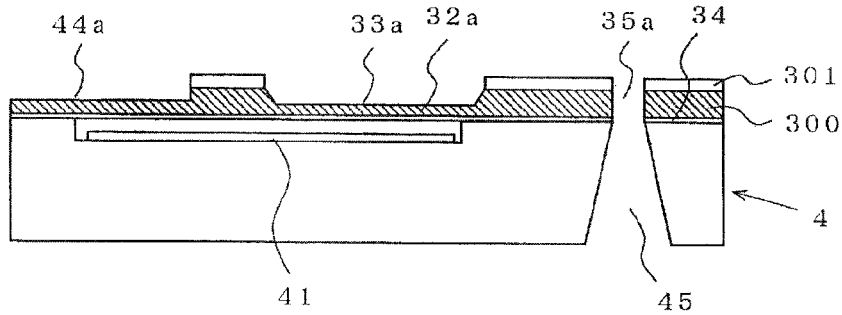

The individual electrodes 41 made of indium tin oxide (ITO) are formed inside the concave portion 42 by sputtering and patterning. Subsequently, a part 45*a* where the ink feed opening 45 is going to be formed is formed by performing blast or the like. In this way, the electrode substrate 4 is fabricated.

b) A cavity base substrate 300 made of silicon and having a thickness of about 220 μm is prepared. A boron-doped layer (not shown in the drawings) having a predetermined thickness is formed on the face where is bonded with the electrode substrate 4, this face is referred as an E-plane. Referring now to FIG. 7B, an insulating film 34 made of an oxide film and having a thickness of 0.1 μm is formed on the E-plane of the cavity base substrate 300 by performing for example a plasma chemical vapor deposition (CVD) using tetraethyl orthosilicate (TEOS). The formation of the insulating film 34 can be performed for example under the following conditions: a temperature is 360° C., a power of a high-frequency radiation is 250 W, a pressure is 66.7 Pa (0.5 Torr), a gas flow rate which is a TEOS gas flow rate is 100 $cm^3$/min (100 sccm), and an oxygen gas flow rate is 1000 $cm^3$/min (1000 sccm). It is preferable that one having a boron-doped layer (not shown in the drawings) which has a predetermined thickness be used as the cavity base substrate 300.

c) Referring now to FIG. 7C, the cavity base substrate 300 (shown in FIG. 7B) and the electrode substrate 4 on which the individual electrodes 41 are formed (shown in FIG. 7A) are anionically bonded each other with the insulating film 34 therebetween. The anionic bonding can be carried out for example in the following way: the cavity base substrate 300 and the electrode substrate 4 are heated to 360° C., a negative electrode is coupled to the electrode substrate 4 and a positive electrode is coupled to the cavity base substrate 300, and a voltage of 800 V is then applied between the electrodes in order to bond the substrates.

d) Referring to FIG. 7D, the surface of the cavity base substrate 300 which has been anionically bonded is polished by a back grinder or a polisher. The affected layer is removed by etching the surface 10-20 μm with a potassium hydroxide solution. The substrate is further made thinner till its thickness becomes 30 μm.

e) Referring to now FIG. 8E, a TEOS oxide film 301 which is going to serve as an etching mask is formed on the surface of the cavity base substrate 300 which has been made thin. The TEOS oxide film 301 is formed to have a thickness of about 1.0 μm by plasma CVD.

f) The surface of the TEOS oxide film 301 is coated with a resist (not shown in the drawings). The resist is then patterned by photolithography. The TEOS oxide film 301 is subsequently etched so as to form parts 33*a*, 35*a*, 44*a* where respectively the first concave portion 33 of the discharge chamber 31, the ink feed opening 35 and the electrode extraction part 44 are formed as shown in FIG. 8F. The resist is removed after the openings of the parts are formed.

g) Referring to FIG. 8G, the part 33*a* where the first concave portion 33 of the discharge chamber 31 is going to be formed and a through hole 35*a* where the ink feed opening 35 is going to be formed are formed in the thinned cavity base substrate 300 by etching this anionically-bonded substrate with a potassium hydroxide solution. At this point, the boron-doped layer has been formed in the area of the part 44*a* where the electrode extraction part 44 is going to be formed thereby the part will remain with the same thickness as that of a part 32*a* where the vibrating plate 32 is going to be formed. The boron-doped layer has also been formed in the through hole 35*a*. However it is removed through the etching process since it is exposed to the potassium hydroxide solution which penetrates through the ink feed opening 45.

Figure 8H:
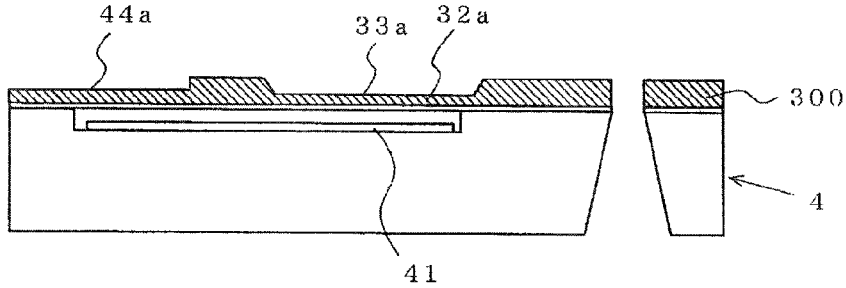
Figure 9I:
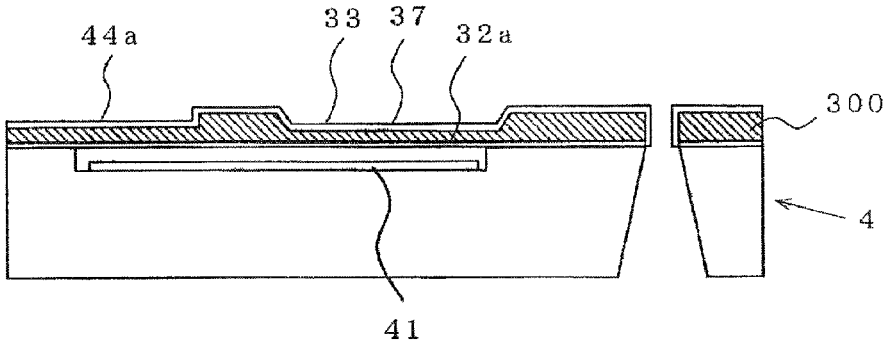
FIGS. 9I and 9J are sectional views of the electrode substrate and the cavity substrate showing their manufacturing process following FIG. 8H.
Figure 9J:
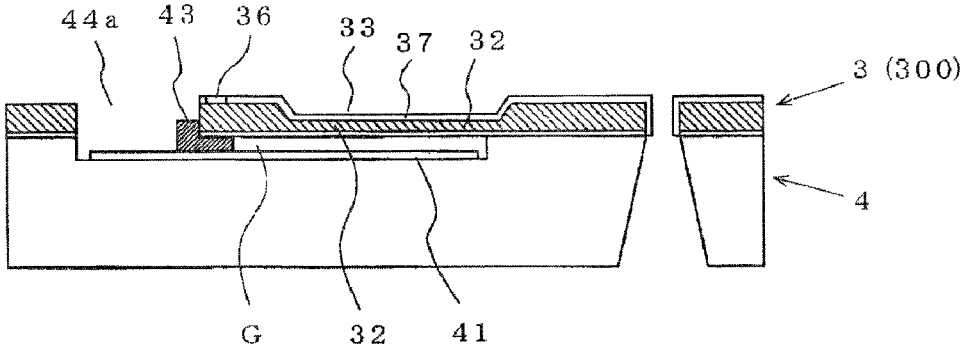

In this etching process, a potassium hydroxide solution of 35 wt % concentration is firstly used to etch the cavity base substrate 300 till its thickness becomes for example 5 μm. A potassium hydroxide solution of 3 wt % concentration is then used in order to generate an effect of etching stop and to prevent the surface of the part 32*a* where the vibrating plate 32 is going to be formed from becoming rough. In this way, it is possible to obtain a desired thickness as fine as 0.80±0.05 μm. Here the etching stop is defined as the state where bubbles are not generated anymore from the etching face. In case of the practical wet-etching, the etching stop is judged by whether bubble generation is stopped or not.

h) After the etching of the cavity base substrate 300 is finished, the TEOS oxide film 301 which is formed on the upper face of the cavity base substrate 300 is remove by etching using a hydrofluoric acid solution as shown in FIG. 8H.

i) Referring now to FIG. 9I, an ink protection film 37 having a thickness of 0.1 μm and made of a TEOS film is formed on the surface of the part 33*a* where the first concave portion 33 is going to be formed in the cavity base substrate 300 by the plasma CVD.

j) Referring now to FIG. 9J, the part 44*a* where the electrode extraction part 44 is going to be formed is opened by a reactive ion etching (RIE) or the like. The open edge of the air gap G between the vibrating plate 32 and the individual electrode 41 is air-tightly sealed by the sealing member 43 made of an epoxy resin or the like. Furthermore, the common electrode 36 which is a metal electrode made of platinum or the like is formed on the peripheral of the cavity base substrate 300 by spattering.

Figure 10K:
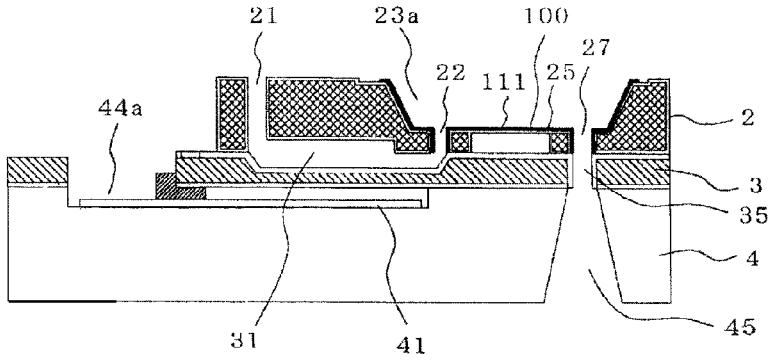
FIGS. 10K through 10M are sectional views of the electrode substrate and the cavity substrate showing their manufacturing process following FIG. 9J.
Figure 10L:
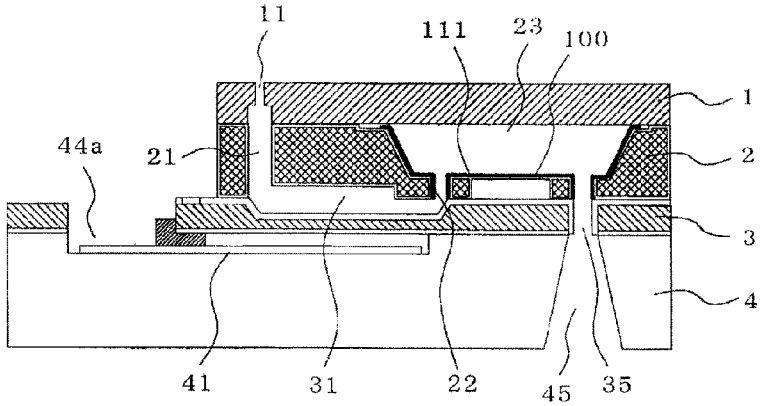
Figure 10M:
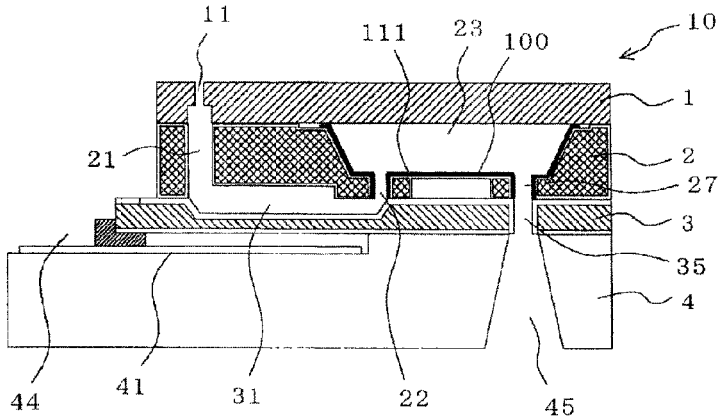

Through the above-described process, the cavity substrate 3 is fabricated from the cavity base substrate 300 to which the electrode substrate 4 is bonded.

k) Referring now to FIG. 10K, the reservoir substrate 2 in which the nozzle communicating opening 21, the feed opening 22, the reservoir concave portion 23*a*, the diaphragm 100 and the like have been formed in the above-described process is adhered to the cavity substrate 3 with an adhesive.

l) Referring to FIG. 10L, the nozzle substrate 1 in which the nozzle opening 11 have been formed is then adhered onto the reservoir substrate 2 with an adhesive.

m) Referring to FIG. 10M, finally, the main body of the ink-jet head 10 shown in FIG. 2 is obtained by dicing the adhered substrates into an individual head.

As described above, the ink-jet head according to the embodiment has a structure in which the diaphragm 100 is formed separately from the discharge chamber 31 in the substrate (the reservoir substrate 2) other than the substrate of the discharge chamber 31 (the cavity substrate 3). Thereby it is possible to secure a sufficient volume of the reservoir 23. Accordingly, the nozzles 11 can be arranged densely. In addition, the compliance of the reservoir 23 can be reduced and this decreases the pressure variation in the reservoir 23. Consequently, it is possible to prevent the pressure interference among the nozzles which occurs when the ink is discharged. In other words, it is possible to obtain a fine discharge characteristic.

Moreover, according to the embodiment, the diaphragm 100 is provided in the reservoir substrate 2 and the diaphragm 100 is included in a head chip. Thereby an external force will not be applied to the diaphragm 100 and the diaphragm 100 can be made thinner. It is possible to enhance the strength against the external force of the head unit without providing a protection member such as a protection cover for the diaphragm 100.

Furthermore, according to the embodiment, the diaphragm 100 in the reservoir substrate 2 is situated at the bottom face of the reservoir 23. Thereby it is possible to make the area of the diaphragm 100 large because the whole bottom face of the reservoir 23 serves as the diaphragm 100. Consequently, the pressure buffering effect of the diaphragm 100 can be increased.

The diaphragm 100 is formed by forming the resin thin film 111 so that the diaphragm 100 and other component can be simultaneously fabricated on the wafer and it improves the production efficiency.

Moreover, according to the embodiment, the void part 110 into which the diaphragm 100 is deflected is formed by etching the face opposite to the face on which the reservoir 23 is formed. This means that it is not necessary to process the cavity substrate 3 and the nozzle substrate 1 in order to form the void part 110. Therefore the design or processing of the cavity substrate 3 and the nozzle substrate 1 will not be affected.

Furthermore, according to the embodiment, the shallow concave portion 23*c* has a depth which is larger than the thickness of the resin thin film 111. Therefore, the surface of the resin thin film 111 will not protrude out from the surface of the shallow concave portion 23*c*. Accordingly, deterioration of the adhesiveness caused by the resin thin film 111 contacting with the nozzle substrate 1 will not happen.

The resin thin film 111 is formed only on the inner face of the reservoir 23 and the bottom face of the shallow concave portion 23*c*. The resin thin film 111 is not formed the bonding faces of the reservoir substrate 2 with the nozzle substrate 1 and with the cavity substrate 3. Thereby the deterioration of the adhesiveness at the bonding faces will not occur since the resin thin film 111 is not interposed therebetween.

Furthermore, according to the embodiment, a part of the resin thin film 111 is cut in the shallow concave portion 23*c*, and the unnecessary part of the resin thin film 111 is removed when the protection film 204 is removed. This simplifies the manufacturing process.

Furthermore, according to the embodiment, the resin thin film 111 is formed of the parylene. Thereby it is possible to form a defect-free resin thin film which has a fine coatability and is highly resistant against heat, chemicals and vapor. In addition, the thin film of the diaphragm 100 which is made of the parylene can exert the pressure absorption effect 100-1000 times greater than that of the case where it is made of for example a silicon thin film.

In the embodiment, the leaser is used to cut the resin thin film 111 so that it can be cut along the desired line.

Moreover, according to the embodiment, the protection film 204 which protects the N-plane when the resin thin film 111 is formed has the opening 204*a* which is larger than the size of the reservoir concave portion 23*a*. Thereby even if the protection film 204 is not well aligned with the reservoir substrate 2, the resin thin film 111 is securely formed on the reservoir concave portion 23*a*. Accordingly it is possible to secure the cutting region of the resin thin film 111.

Moreover, according to the embodiment, the C-pane of the reservoir substrate 2 is also protected by the protection film 203 so that it is possible to prevent the resin thin film 111 from being formed on the boding face of the reservoir substrate 2 with the cavity substrate 3. Consequently, the deterioration of the adhesiveness at the bonding face between the reservoir substrate 2 and the cavity substrate 3 will not occur since the resin thin film 111 is not interposed therebetween.

Furthermore, according to the embodiment, hydrophilicity is imparted to the surface of the resin thin film 111 through the oxide plasma treatment. Therefore, it is easy to secure the hydrophilicity for the droplet flow channels.

Moreover, according to the embodiment, the SF6 plasma is used in the dry-etching for forming the diaphragm 100.

Therefore, it is possible to minimize the damage given to the resin thin film 111 when the silicon is dry-etched.

Furthermore, according to the embodiment, the void part 110 is provided on the side of the bonding face of the reservoir substrate 2 with the cavity substrate 3. In other words, the discharge chamber 3 is formed on the opposite side to the side where the reservoir 23 is formed in the reservoir substrate 2. Thereby, the reservoir 23 can be placed such that it overlaps the discharge chamber 31 of the cavity substrate 3, and it is possible to minimize the area of the ink-jet head.

Though the parylene is used for forming the resin thin film 111 in the above-described embodiment, the resin thin film 111 can be formed of other material such as Cytop© transparent fluoropolymers (product by Asahi Glass Co. LTD).

Figure 11:
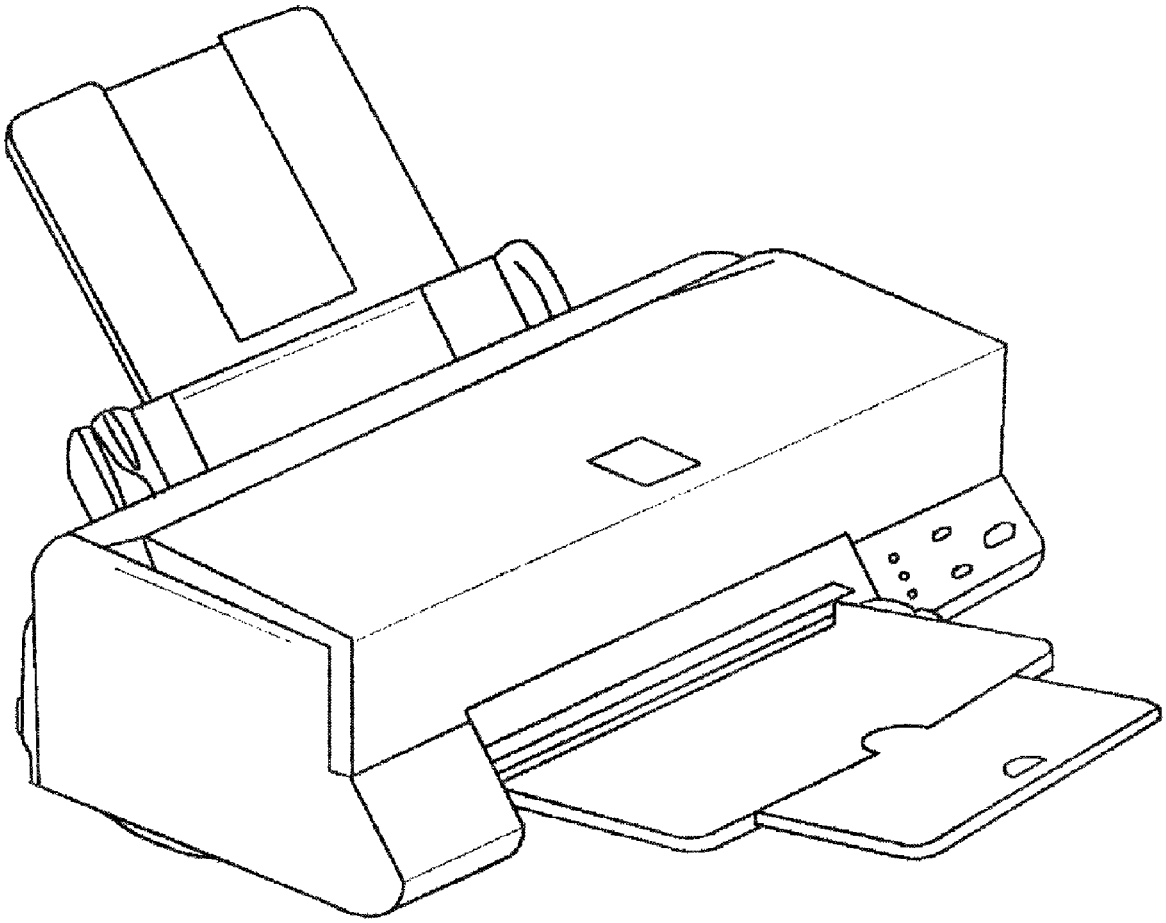
FIG. 11 is a perspective view of an ink-jet printer according to an embodiment of the invention.

Though the electrostatic driving type ink-jet head and the manufacturing method thereof have been described in the above embodiment, the invention is obviously not limited to the specific embodiments herein, but also encompasses any variations that may be considered by any person skilled in the art, within the general scope of the invention. For example, the invention can be also applied to other driving type ink-jet head in addition to the electrostatic driving type. In the case of a piezoelectric type, a piezoelectric element is adhered to the bottom face of each discharge chamber instead of the electrode substrate. In the case of a bubble type, a heat element is provided on the bottom face of each discharge chamber. The ink-jet head 10 according to the embodiment can be used for fabrication of various parts components of various devices by changing the kinds of droplets discharged from the head. In addition to the ink-jet printer shown in FIG. 11, the ink-jet head 10 can be used in various droplet discharge devices which are used for fabrication of color filters for a liquid crystal display, fabrication of electroluminescence elements in an organic electroluminescence (EL) display device, fabrication of wirings of wiring substrates manufactured by a print wiring substrate manufacturing apparatus, discharge of biological liquid (fabrication of protein-chips and DNA chips) and the like. A droplet discharge device equipped with the ink-jet head (droplet discharge head) according to the above embodiment can have a fine discharge characteristic because the pressure interference among the nozzle that occurs when droplets are discharged is prevented.

What is claimed is:

1. A droplet discharge head, comprising:

a nozzle substrate having a nozzle opening, the nozzle opening being provided in a plural number;

a cavity substrate having a discharge chamber that communicates the nozzle opening and discharges a droplet from the nozzle opening, the discharge chamber is provided in a plural number, and each of the discharge chambers independently communicating with the corresponding nozzle opening;

a reservoir substrate having a reservoir concave portion that serves as a reservoir which communicates commonly with the discharge chambers, the reservoir substrate being provided between the nozzle substrate and the cavity substrate; and a resin thin film formed on a whole inner face of the reservoir concave portion and on a bottom face of a second concave portion, the second concave portion being provided in a peripheral of the reservoir concave portion and having a depth smaller than a depth of the reservoir concave portion, wherein the resin thin film provided on the bottom face of the second concave portion is cut circularly so as to surround the reservoir concave portion, and a part of the resin thin film provided on a bottom face of the reservoir concave portion serves as a diaphragm buffering pressure variation.

2. The droplet discharge head according to claim 1, wherein a void part is provided on a side opposite to the reservoir concave portion with respect to the resin thin film provided on the bottom face of the reservoir concave portion, and the void part is formed by etching the reservoir substrate from a surface opposite to a face where the reservoir concave portion is formed to the diaphragm.

3. The droplet discharge head according to claim 1, wherein the second concave portion has a depth larger than a thickness of the resin thin film.

4. The droplet discharge head according to claim 1, wherein the resin thin film is made of parylene.

5. The droplet discharge head according to claim 1, wherein the void part is provided on a bonding face of the reservoir substrate where the cavity substrate is bonded.

6. A droplet discharge device comprising the droplet discharge head according to claim 1.

* * * * *